US011963554B2

(12) United States Patent
Rogan

(10) Patent No.: US 11,963,554 B2
(45) Date of Patent: Apr. 23, 2024

(54) VAPOUR GENERATING DEVICE WITH SENSORS TO MEASURE STRAIN GENERATED BY A VAPOUR GENERATING MATERIAL

(71) Applicant: JT International S.A., Geneva (CH)

(72) Inventor: Andrew Robert John Rogan, Forres (GB)

(73) Assignee: JT International S.A. (CH)

( * ) Notice: Subject to any disclaimer, the term of this patent is extended or adjusted under 35 U.S.C. 154(b) by 764 days.

(21) Appl. No.: 17/057,982

(22) PCT Filed: May 23, 2019

(86) PCT No.: PCT/EP2019/063336
§ 371 (c)(1),
(2) Date: Nov. 23, 2020

(87) PCT Pub. No.: WO2019/224310
PCT Pub. Date: Nov. 28, 2019

(65) Prior Publication Data

US 2021/0204610 A1 Jul. 8, 2021

(30) Foreign Application Priority Data

May 25, 2018 (EP) ..... 18174435

(51) Int. Cl.
*A24F 40/53* (2020.01)
*A24F 40/20* (2020.01)
(Continued)

(52) U.S. Cl.
CPC ..... *A24F 40/53* (2020.01); *A24F 40/42* (2020.01); *A24F 40/51* (2020.01); *A24F 40/57* (2020.01); *A24F 40/20* (2020.01)

(58) Field of Classification Search
CPC ..... A24F 40/20; A24F 40/42; A24F 40/51; A24F 40/53; A24F 40/57; A24F 40/40;
(Continued)

(56) References Cited

U.S. PATENT DOCUMENTS 6,396,002 B1 * 5/2002 Hove ..... B65B 19/32 141/83
2011/0226236 A1 9/2011 Buchberger
(Continued)

FOREIGN PATENT DOCUMENTS

CN 102264249 A 11/2011
CN 106231937 A 12/2016
(Continued)

OTHER PUBLICATIONS

International Search Report including Written Opinion for PCT/EP2019/063336 dated Jul. 3, 2019; 12 pages.
(Continued)

*Primary Examiner* — John Fitzgerald
*Assistant Examiner* — Truong D Phan
(74) *Attorney, Agent, or Firm* — Lerner David LLP

(57) ABSTRACT

A vapour generating device has a chamber in which strain gauges are arranged to measure a strain generated by a vapour generating material received in the chamber. The strain gauges 4 are arranged on a sidewall of the chamber. A controller determines an operation based on the measured strain; operations include selecting heating profiles to be applied to the vapour generating material, adjusting the retention to draw, and preventing or allowing the device from operating with the vapour generating material.

15 Claims, 5 Drawing Sheets

(51) Int. Cl.

| | |
|---|---|
| ***A24F 40/42*** | (2020.01) |
| ***A24F 40/51*** | (2020.01) |
| ***A24F 40/57*** | (2020.01) |

(58) Field of Classification Search

CPC ..... A24F 40/60; A24F 15/00; A24F 40/10; A24F 40/46; A24F 40/465; A24F 40/50; A24F 1/24; H05B 1/0244; H05B 3/44

See application file for complete search history.

(56) References Cited

U.S. PATENT DOCUMENTS

| | | | | |
|---|---|---|---|---|
| 2016/0213065 | A1 | 7/2016 | Wensley et al. | |
| 2017/0071251 | A1 | 3/2017 | Goch | |
| 2018/0049469 | A1 | 2/2018 | Kaufman et al. | |
| 2018/0192702 | A1* | 7/2018 | Li | H05B 1/0277 |
| 2018/0357365 | A1* | 12/2018 | Meadow | C12Q 1/6813 |
| 2020/0035119 | A1* | 1/2020 | Pandolfino | G09B 19/00 |
| 2020/0237004 | A1* | 7/2020 | Larsen | A24F 40/20 |
| 2021/0007393 | A1* | 1/2021 | Jung | A24F 40/20 |

FOREIGN PATENT DOCUMENTS

| | | | |
|---|---|---|---|
| CN | 107995846 | A | 5/2018 |
| JP | 2017510270 | A | 4/2017 |
| WO | 2016005602 | A1 | 1/2016 |
| WO | 2017036865 | A1 | 3/2017 |
| WO | 2017045899 | A1 | 3/2017 |
| WO | 2017207586 | A1 | 12/2017 |
| WO | 2019020151 | A1 | 1/2019 |

OTHER PUBLICATIONS

Search Report dated Feb. 10, 2023 from the Office Action for Chinese Application No. 201980035250.X dated Feb. 13, 2023, pp. 1-3.

* cited by examiner

VAPOUR GENERATING DEVICE WITH SENSORS TO MEASURE STRAIN GENERATED BY A VAPOUR GENERATING MATERIAL

CROSS-REFERENCE TO RELATED APPLICATIONS

The present application is a national phase entry under 35 U.S.C. § 371 of International Application No. PCT/EP2019/063336, filed May 23, 2019, published in English, which claims priority to European Application No. 18174435.0 filed May 25, 2018, the disclosures of which are incorporated herein by reference.

BACKGROUND

In traditional cigarettes tobacco is burned and the smoke is inhaled. An alternative to traditional cigarettes are heat-not-burn devices. Heat-not-burn devices heat tobacco at a lower temperature for vaporisation or aerosolisation, rather than burning it. Another alternative to traditional cigarettes is the vaporisation of liquid products which may be based on mixtures of propylene glycol, glycerin, and nicotine.

Heating devices for vaporisation or aerosolisation are known in the art. Such devices typically include a heating chamber and heater. In operation, an operator inserts the product to be vaporised into the heating chamber. The product is then heated with an electronic heater to vaporise the constituents of the product for the operator to inhale. In some examples, the tobacco product may be similar to a traditional cigarette, in other examples the product may be a liquid, or liquid contents in a capsule.

Problems faced by known devices include providing optimal heating profiles and preventing the use of substandard counterfeit vapour generating materials to achieve an optimal user experience.

SUMMARY OF INVENTION

According to an aspect the present invention provides a vapour generating device comprising a chamber for receiving a vapour generating material, a vaporiser for vaporising a vapour generating material received in the chamber, at least one strain gauge arranged to measure a strain generated by a vapour generating material received in the chamber, and a controller arranged to determine an operation that is dependent on the measured strain. In this way a vapour generating material can be received in the vapour generating device and an operation can be determined based upon the measured strain so that a next step can be automatically taken without further user interaction being required.

Preferably the vaporiser is a heater arranged to engage a vapour generating material received in the chamber. In this way the vapour generating material can be heated to produce a vapour.

The heater may be projected from the bottom of the chamber and inserted into the vapour generating material when in use. In this way the combination of the strain gauge at the side wall of the chamber and the heater projecting from the bottom of the chamber, to be inserted in the vapour generating material, provides a simple and easy configuration of the device.

The heater may be an element-type heater, an infra-red heater, a laser heater, an induction heater or any other suitable means for heating a vaporisable product. Alternatively an ultrasonic vaporiser may be used in place of the heater.

Preferably the generated strain is related to a dimension or shape of a vapour generating material received in the chamber. In this way the user is not required to input specific information regarding the vapour generating material separately to optimise the performance of the vapour generating device for the specifically inserted vapour generating material as this can be determined automatically based on the generated strain.

Preferably the at least one strain gauge is connected to at least one side wall of the chamber. In this way the vapour generating material received in the chamber can interact with the at least one strain gauge, for strain determination to be carried out.

Preferably there are two or more strain gauges. In this way the applied strain can be averaged across multiple strain gauges thereby providing a more accurate measurement.

Preferably the two or more strain gauges are evenly distributed around side walls of the chamber. In this way, the vapour generating material is guided to the centre of the chamber for efficient engagement with the heater.

The strain gauge(s) may be plate shaped. In this way, the vapour generating material efficiently interacts with the strain gauge(s) when inserted into the chamber.

The overall applied strain may be calculated as the average strain generated across each of the strain gauges.

The strain gauges may be made from a flexible material with resilient properties such as a plastic.

The strain gauges may be arranged in the same plane in the chamber. Alternatively, the strain gauges may be offset from one another in the direction of insertion of the vapour generating material along the length of the chamber.

Preferably the strain gauge(s) is/are arranged to guide the vapour generating material toward a desired position in the chamber. In this way the strain gauges can contribute to ensuring that the vapour generating material is correctly positioned in the chamber, for example for engagement with the vaporiser.

Preferably the strain gauge(s) is/are oriented in the direction of insertion. In this way the orientation in the direction of insertion can guide the vapour generating material to the bottom of the chamber so that it may be fully inserted.

Preferably the vaporiser is at an end of the chamber opposite an opening of the chamber, and the strain gauge(s) is/are positioned closer to an opening of the chamber than the vaporiser. In this way the vapour generating material can interact with the strain gauges for measurement before interacting with the vaporiser; this can provide a more accurate detection as, at the time of the detection, there is no pressure other than that from the strain gauge on the vapour generating material. Further, the strain gauge(s) can work as a guide so that the vapour generating material can be efficiently inserted in relation to the position of the vaporiser; the vapour generating material can be guided to the correct position before engaging the vaporiser.

Preferably the size of an air inlet defined by a cross sectional area of the chamber, the strain gauge(s) and a vapour generating material received in the chamber is adjusted according to the cross sectional shape of the vapour generating material received in the chamber, thereby adjusting the retention to draw. In this way the user experience can be enhanced as the retention to draw is able to be adjusted optimally for each vapour generating material.

Preferably the controller is arranged to compare the measured strain generated by a vapour generating material received in the chamber to a predetermined threshold strain, and select an operation that prevents the vapour generating device from operating with the vapour generating material received in the chamber if the measured strain is less than or more than the predetermined threshold strain. In this way the vapour generating device can be prevented from operating with the vapour generating material if the vapour generating material generates a strain that is less than a predetermined threshold strain; if the vapour generating material generates a strain that is greater than or equal to the predetermined threshold an operation can be selected that allows the vapour generating device to operate with the vapour generating material. Advantageously, this can prevent the use of the wrong vapour generating material in the device, thereby preventing possible damage to, or failure of, the device and/or vapour generating material. Furthermore, a poor connection between the vapour generating material and vaporiser, or an overheating of the vapour generating material, can be prevented if the vapour generating material is the wrong size for the vaporiser.

Preferably the controller is arranged to compare the measured strain generated by a vapour generating material received in the chamber to stored information corresponding to strains generated by authorised vapour generating materials, determine if the vapour generating material received in the chamber is an authorised vapour generating material based on the comparison, and select an operation that prevents the vapour generating device from operating with the vapour generating material received in the chamber if the vapour generating material does not correspond an authorised vapour generating material. In this way the vapour generating device can be prevented from operating with the vapour generating material if the vapour generating material is not an authorised vapour generating material based on the comparison; if the vapour generating material is determined to be an authorised material based on the comparison, an operation can be selected that allows the vapour generating device to operate with the vapour generating material. Advantageously this can prevent third party vapour generating materials, which may give a sub-optimal user experience, from being used.

Preferably the controller is arranged to compare the measured strain generated by a vapour generating material received in the chamber to stored information corresponding to strains generated by vapour generating materials with associated stored heating profiles, and select an operation, wherein the operation is a heating profile, from the stored heating profiles for use with the vapour generating material received in the chamber based on the measured strain. In this way the user experience is can be enhanced by heating the vapour generating material to an optimal temperature.

Preferably the controller is arranged to determine a type of a vapour generating material received in the chamber based on the measured strain, and indicate the type of the vapour generating material received in the chamber to a user of the vapour generating device. In this way the user can check that the correct vapour generating material has been inserted without having to remove the vapour generating material from the chamber.

According to another aspect the present invention provides a system comprising the device of the first aspect with a vapour generating material received in the chamber.

The vapour generating material may be a tobacco rod, such as a cigarette. Alternatively the vapour generating material may be a capsule comprising a liquid in a shell. The capsule may have a liquid permeable part such as a cotton layer arranged to be between the heater and a liquid reservoir inside the capsule so that the liquid can be supplied to the heater.

The vapour generating material (for example, a tobacco consumable) may be a capsule which includes a vaporisable substance inside an air permeable material. Alternatively, the vapour generating material may be a vaporisable substance held inside a material that is not air permeable, but which comprises appropriate perforation or openings to allow air flow. Alternatively, the vapour generating material may be the vaporisable substance itself. Alternatively, vapour generating material may be formed substantially in the shape of a stick which may have a mouthpiece filter. In this case the vapour generating material may be a sheet such as paper wrapped vaporisable substance. In other terms, the vapour generating material may include a rod with a vaporisable substance (such as tobacco) wrapped in a wrapper, such as paper, in the shape of a rod. The vapour generating rod may have a filter such as an acetate filter at its end. The material including the vaporisable material may have a high air permeability to allow air to flow through the material with a resistance to high temperatures. Examples of suitable air permeable materials include cellulose fibres, paper, cotton and silk. The air permeable material may also act as a filter. Alternatively, the vapour generating material may be a vaporisable substance wrapped in paper. If electrical magnetic field is used to generate heat, the material including the vaporisable substance may be a material which is electrically insulating and non-magnetic.

The vaporisable substance (for example, tobacco) may be any suitable substance capable of forming a vapour. The substance may be solid or semi-solid substance. The substance may comprise plant derived material and in particular, the substance may comprise tobacco. Typically, the vaporisable substance is a solid or semi-solid tobacco substance. Example types of vapour generating solids or semi-solids include powder, granules, pellets, shreds, strands, porous material, foam or sheets. The substance may be a tobacco foam; tobacco foam typically comprises a plurality of fine tobacco particles and can typically also comprise a volume of water and/or a moisture additive, such as a humectant. The tobacco foam may be porous, and may allow a flow of air or vapour through the foam. Preferably, the vaporisable substance may comprise an aerosol-former. Examples of aerosol-formers include polyhydric alcohols and mixtures thereof such as glycerine or propylene glycol. Typically, the vaporisable substance may comprise an aerosol-former content of between approximately 5% and approximately 50% on a dry weight basis. Preferably, the vaporisable substance may comprise an aerosol-former content of approximately 10-20% on a dry weight basis. More preferably, the vaporisable substance may comprise an aerosol-former content of approximately 15% on a dry weight basis. Also, the vaporisable substance may be the aerosol-former itself. In this case, the vaporisable substance may be liquid. Also, in this case, the vapour generating material may have a liquid retaining substance (e.g. a bundle of fibres, porous material such as ceramic, etc.) which retains the liquid to be vaporized by the vaporizer such as a heater and allows a vapour to be formed and released/emitted from the liquid retaining substance towards the air outlet for inhalation by a user. If electrical magnetic field is used to generate heat, solid or semi-solid vaporisable substance allows the susceptor to be held and kept in position within the vapour generating material so that heating is able to be provided efficiently and consistently.

In the context of the present disclosure, an aerosol and a vapour can be considered interchangeable expressions. That is, an aerosol is a vapour and a vapour is an aerosol. An aerosol for smoking may refer to an aerosol with particle sizes of 0.5-7 microns. The particle size may be less than 10 or 7 microns.

In some cases the vapour generating device uses an induction heating system. The power source and circuitry of the vapour generating device may be configured to operate at a high frequency. Preferably, the power source and circuitry may be configured to operate at a frequency of between approximately 80 kHz and 500 kHz, preferably approximately 150 kHz and 250 kHz, more preferably approximately 200 kHz. The assembly may be arranged to operate in use with a fluctuating electromagnetic field having a magnetic flux density of between approximately 0.5 Tesla (T) and approximately 2.0 T at the point of highest concentration. Whilst the induction coil may comprise any suitable material, typically the induction coil may comprise a Litz wire or a Litz cable.

The susceptor may comprise one or more, but not limited, of aluminium, iron, nickel, stainless steel and alloys thereof, e.g. nickel chromium. With the application of an electromagnetic field in its vicinity, the susceptor may generate heat due to eddy currents and magnetic hysteresis losses resulting in a conversion of energy from electromagnetic to heat.

The chamber may have a substantially circular cross section defined by a sidewall. Alternatively, the cross section may be of a square, rectangle, oval, or any other shape, with one or more sidewalls. The vapour generating material may have a substantially circular cross sectional shape. Alternatively, the cross section may also be of a square, rectangle, oval, or any other suitable shape. The cross sectional shape of the vapour generating device or vapour generating material may be or may not be the same as the cross sectional shape of the chamber.

DETAILED DESCRIPTION

Figure 1:
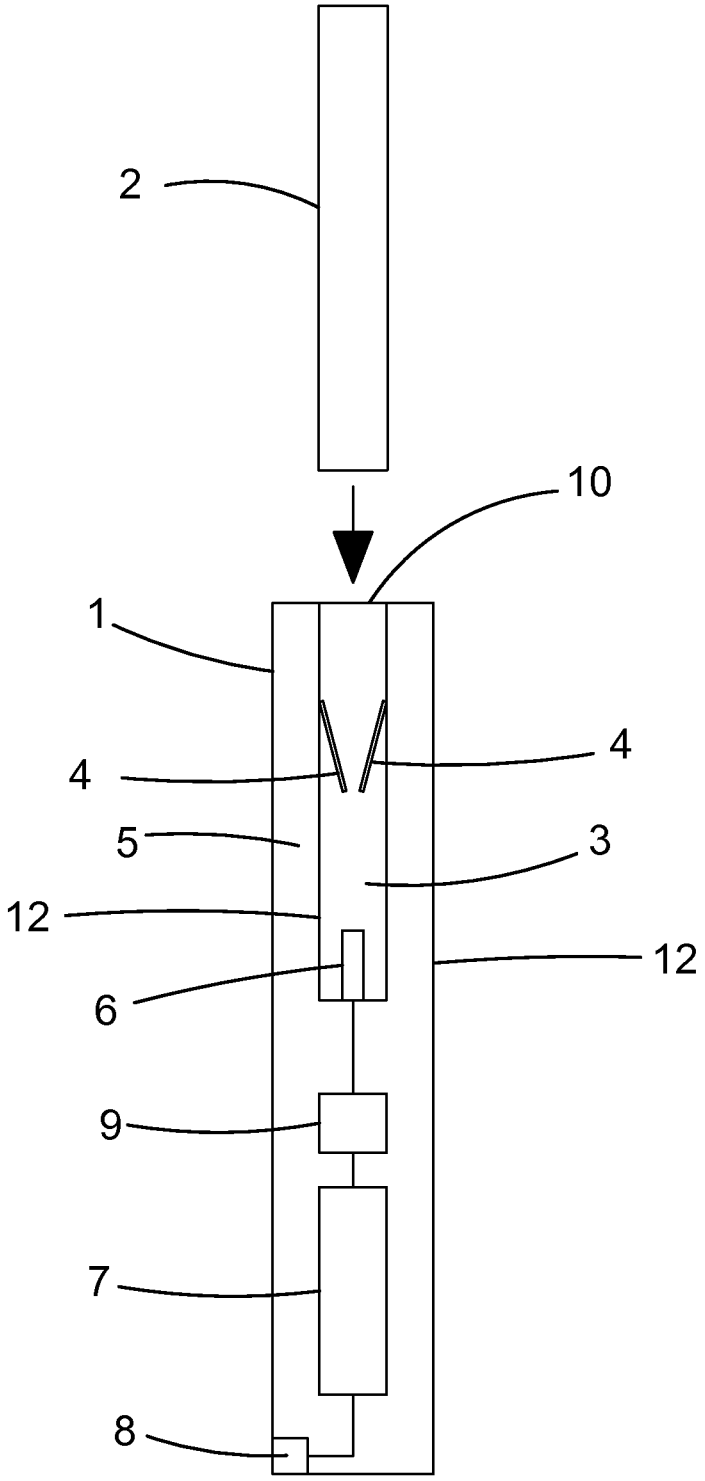
FIG. 1 shows a diagram of a vapour generating system according to an embodiment of the invention.

FIG. 1 shows a diagram of a vapour generating system according to an embodiment of the invention. The system comprises a vapour generating device 1 and a vapour generating material 2. In an embodiment, the vapour generating material is a tobacco rod 2. The vapour generating device 1 comprises a body 5 in which a chamber 3 is located. The chamber 3 is arranged to receive the tobacco rod 2 through an opening 10. A heater or vaporiser 6 is arranged in the chamber 3 to vaporise the vaporisable constituents of the tobacco rod 2.

An internal power supply 7, such as a rechargeable battery, is arranged in the body 5 to provide power to the heater 6. An external power input 8 is arranged in connection with the internal power supply 7 so that the internal power supply 7 can be charged and recharged as required. The internal power supply 7 is connected to the heater 6 by way of a controller 9. The controller 9 is arranged to provide power to the heater 6 when instructed by a user input, for example by an operable button on the body 5. Alternatively, the controller 9 can be arranged to automatically provide power to the heater 6 upon detection of a tobacco rod 2 in the chamber 3. The heater 6 can be an element-type heater, an infra-red heater, a laser heater, an induction heater or any other suitable means for heating a vaporisable product. In an alternative an ultrasonic vaporiser can be used in place of the heater.

In use, the tobacco rod 2 is inserted through the opening 10 and received in the chamber 3. The heater 6 has a spiked shape which engages the tobacco rod 2 by being inserted into the tobacco rod 2. The tobacco rod 2 is heated by the heater 6 and the user may then draw on the heated tobacco rod 2 to produce a vapour. The user may subsequently remove the spent tobacco rod 2 through the opening 10 when the use is completed.

Sensors 4 are arranged in the chamber 3 to measure one or more physical attributes of the tobacco rod 2. The sensors are strain gauges 4 attached to the sidewalls 12 of the chamber 3. The strain gauges 4 are explained in more detail with reference to FIGS. 2A, 2B, 3A, 3B, 4A and 4B.

Figure 2B:
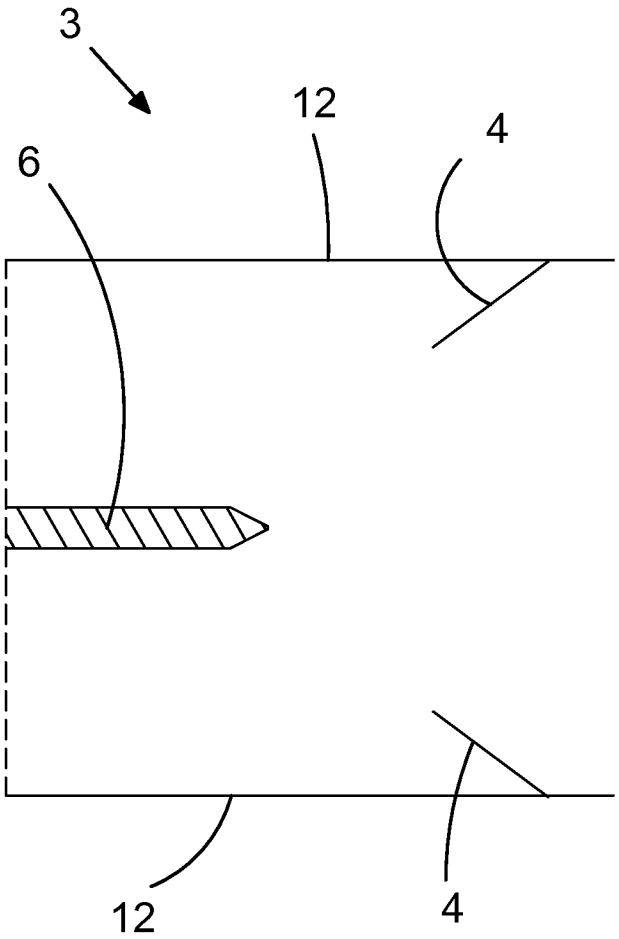
FIG. 2B shows a cross sectional diagram along line A of FIG. 2A.
Figure 2A:
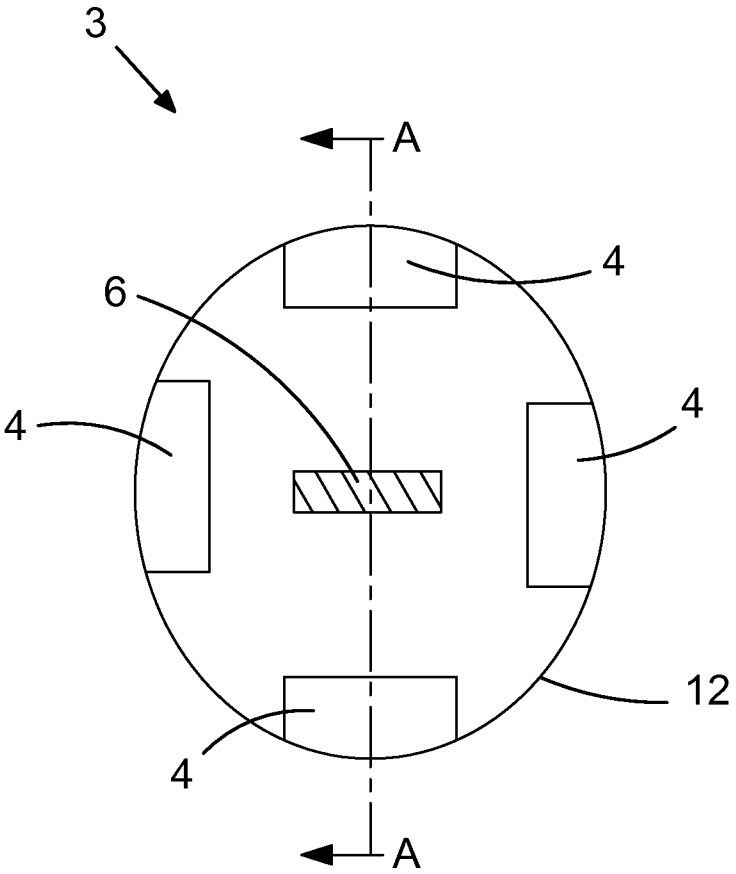
FIG. 2A shows a cross sectional diagram of a heating chamber.

FIGS. 2A and 2B show cross sections of the chamber 3. FIG. 2A shows a cross section of the chamber 3 perpendicular to the direction of insertion of the tobacco rod 2. FIG. 2B shows a cross section of the chamber 3 along line A of FIG. 2A. The chamber 3 has a substantially circular cross section defined by a sidewall 12. In alternate embodiments the cross section could also be of a square, rectangle, oval, or any other shape, with one or more sidewalls. Four strain gauges 4 extend from the sidewall 12 of the chamber 3 inwardly to the centre of the chamber 3 and in the direction of insertion of the tobacco rod 2, toward the heater 6. This arrangement guides the tobacco rod 2 to the centre of the chamber 3 and toward the heater 6 so that the tobacco rod 2 is easily engaged with the heater. Although four strain gauges 4 are shown, in alternate embodiments any other number of strain gauges 4 may be used. The strain gauges 4 are planar in shape. The strain gauges 4 are arranged in the same plane in the chamber 3. In alternate embodiments the strain gauges can be offset from one another in the direction of insertion of the tobacco rod along the length of the chamber.

The strain gauges 4 are located between the heater 6 and the opening 10 to the chamber 3 so that, when the tobacco rod 2 is inserted into the chamber 3, the tobacco rod 2 interacts with the strain gauges 4 before it is engaged by the heater 6.

Figure 3B:
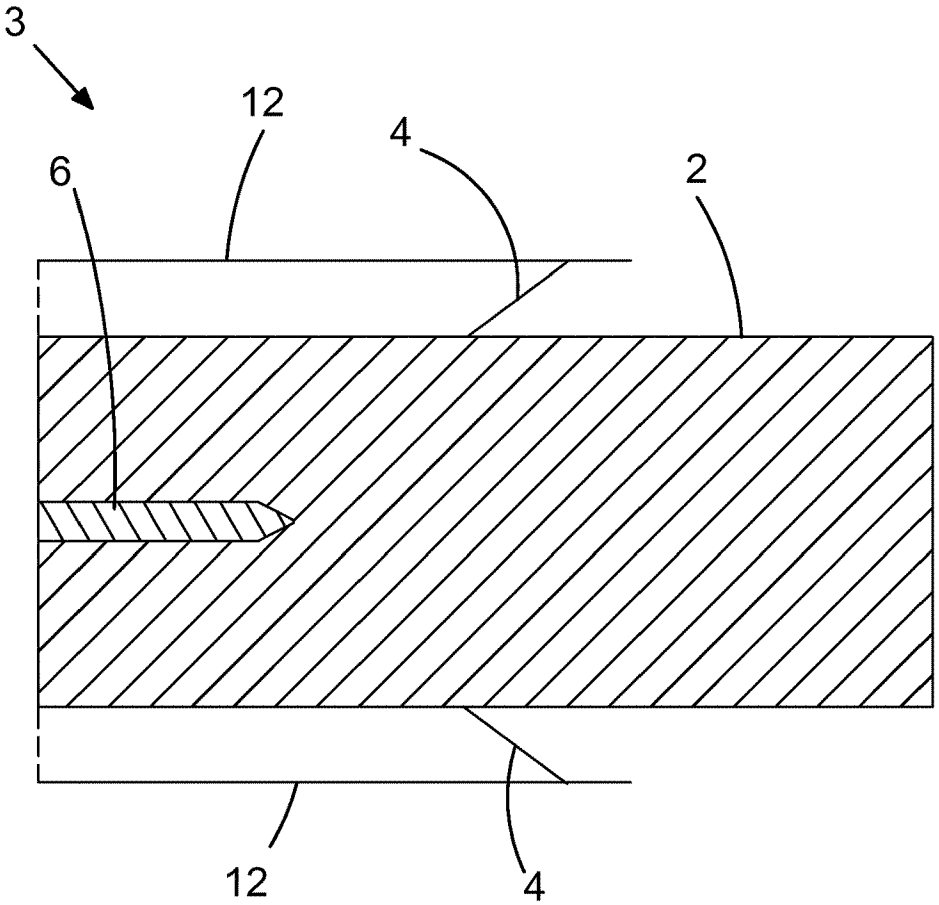
FIG. 3B shows a cross sectional diagram along line A of FIG. 3A.
Figure 3A:
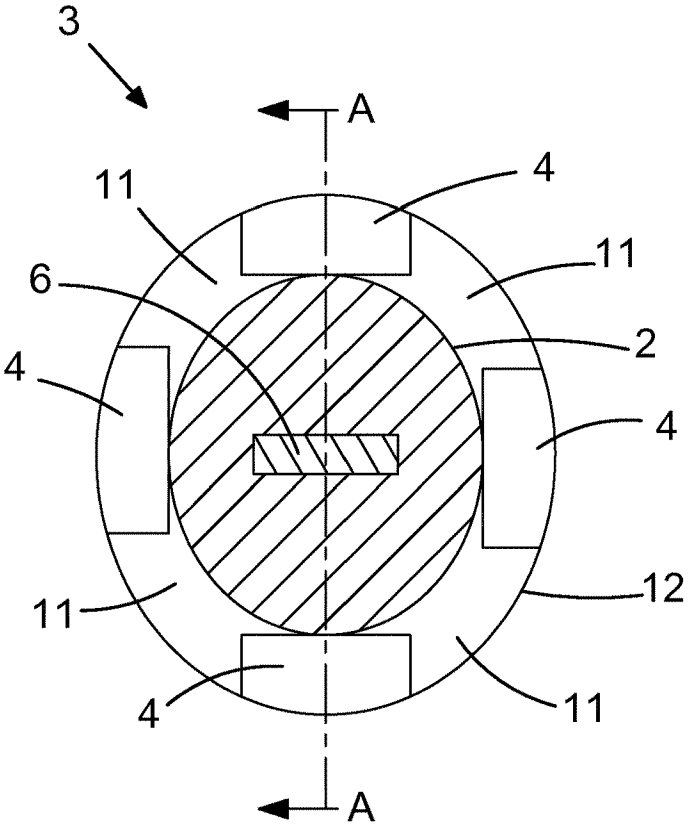
FIG. 3A shows a cross sectional diagram of a heating chamber.

FIGS. 3A and 3B show diagrams of the chamber 3 after a tobacco rod 2 of a first size has been received. FIG. 3A shows a cross section of the chamber 3 perpendicular to the direction of insertion of the tobacco rod 2. FIG. 3B shows a cross section of the chamber 3 along line A of FIG. 3A.

Figure 4B:
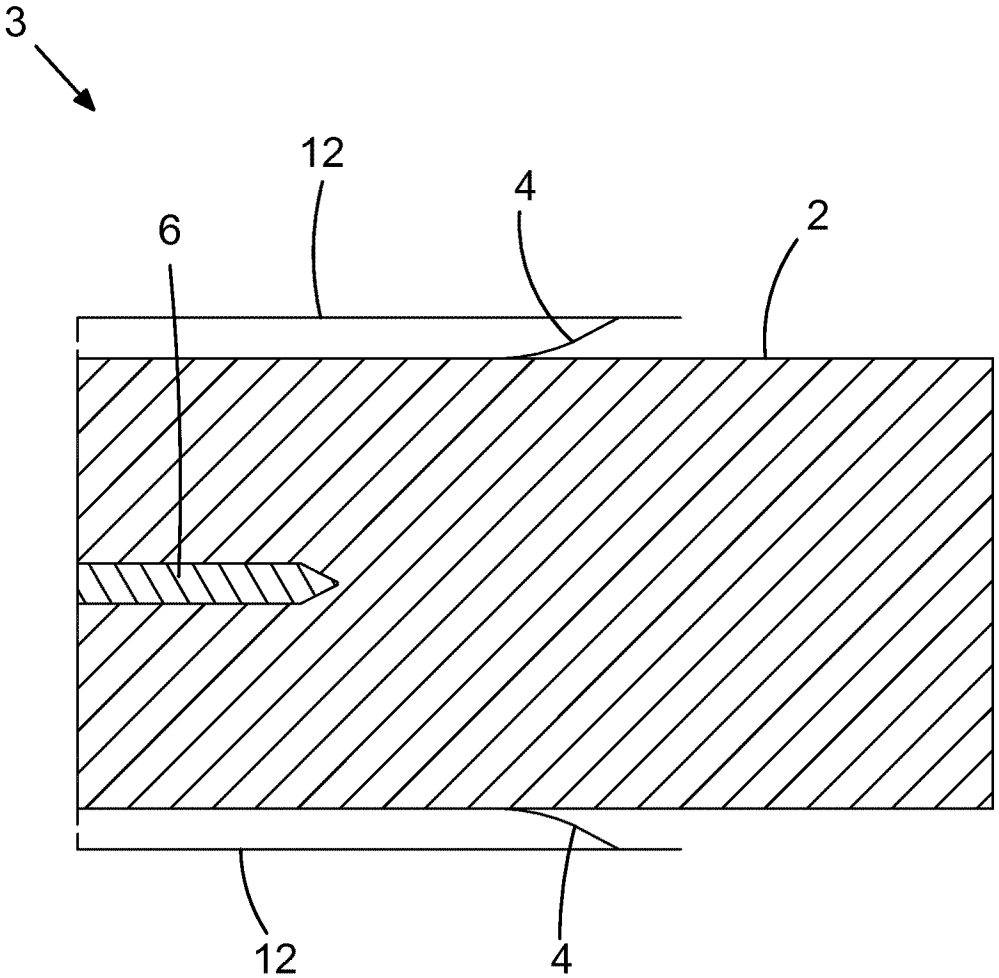
FIG. 4B shows a cross sectional diagram along line A of FIG. 4A.
Figure 4A:
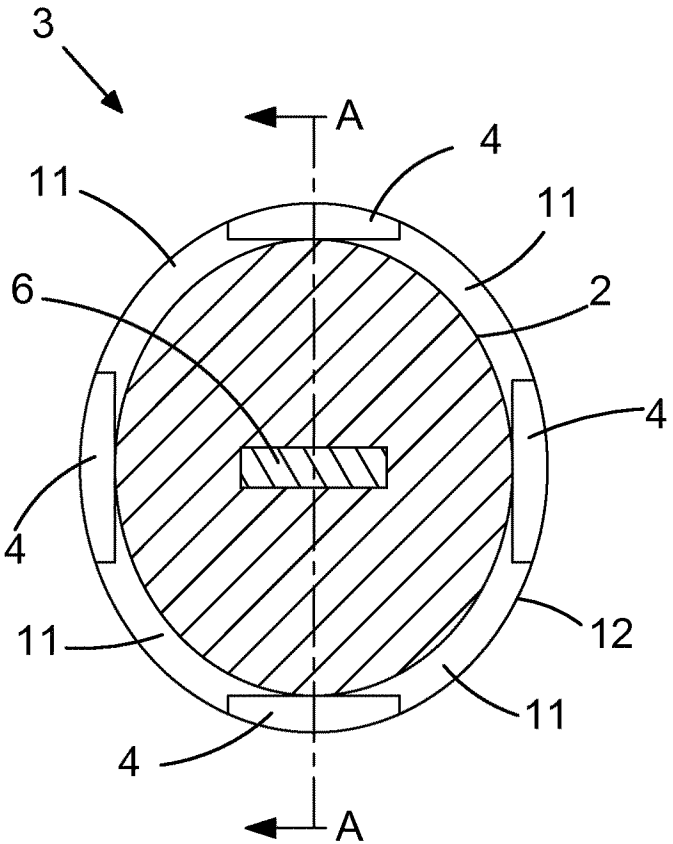
FIG. 4A shows a cross sectional diagram of a heating chamber.
Figure 5D:
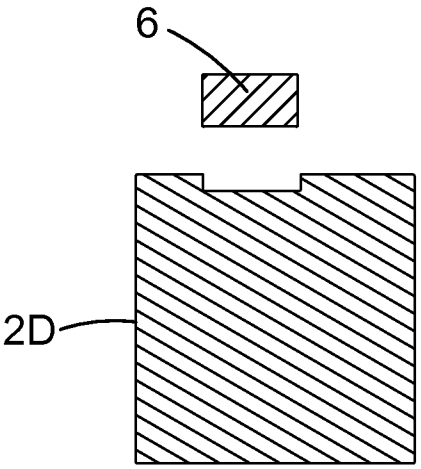
FIGS. 5A-D show diagrams of the interaction between heaters and vapour generating materials of varying sizes.
Figure 5C:
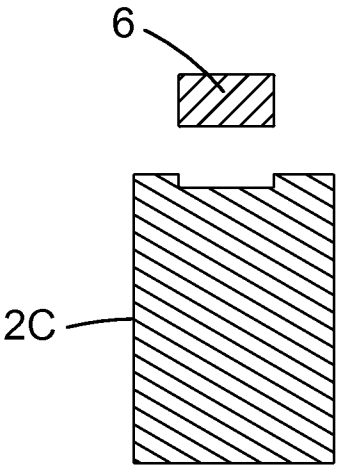
Figure 5B:
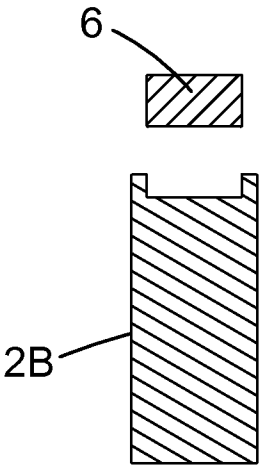
Figure 5A:
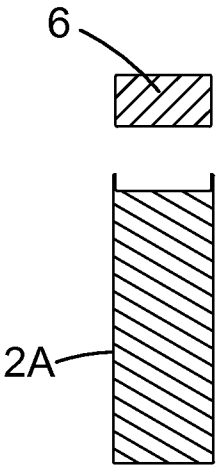

FIGS. 4A and 4B show diagrams of the chamber 3 after a tobacco rod 2 of a second size has been received. FIG. 4A shows a cross section of the chamber 3 perpendicular to the direction of insertion of the tobacco rod 2. FIG. 4B shows a cross section of the chamber 3 along line A of FIG. 4A.

The tobacco rod 2 of the second size is larger in diameter than the tobacco rod 2 of the first size, as shown in FIGS. 3A, 3B and 4A, 4B respectively. The tobacco rod 2 has a substantially circular cross sectional shape. In alternate embodiments the cross section could also be of a square, rectangle, oval, or any other suitable shape. The cross sectional shape of the vapour generating device or tobacco rod need not be the same as the cross sectional shape of the chamber.

When the tobacco rod 2 is received in the chamber 3 it engages with the heater 6 so that the tobacco rod 2 can be heated for vaporisation. When the tobacco rod 2 is inserted into the chamber 3 it interacts with the strain gauges 4. This interaction applies a strain to the strain gauges 4. The strain is proportional to how far the strain gauges 4 are displaced in a direction perpendicular to the direction of insertion of the tobacco rod 2. The strain gauges are displaced by a bending of the strain gauge 4 toward the sidewall 12 of the chamber 3 due to the applied pressure from the abutment with the tobacco rod 2. The applied strain to each of the strain gauges 4 relates to dimensions or the cross sectional shape of the tobacco rod 2. The overall applied strain can be calculated as the average strain generated across each of the strain gauges. The strain gauges 4 are made from a flexible material with resilient properties such as a plastic.

Inserting a thicker tobacco rod 2, or one with a larger diameter, into the chamber 3 will result in a greater bending of the strain gauges 4 than that resulting from a thinner tobacco rod 2, or one with a smaller diameter. This is visually represented in FIGS. 3B and 4B wherein the strain gauges 4 are shown to be more greatly bent for the tobacco rod 2 of the larger second size (FIG. 4B) than for the tobacco rod 2 of the smaller first size (FIG. 3B).

When looking to FIGS. 3A and 3B the portion of the chamber 3 not occupied by a strain gauge 4 or the tobacco rod 2 constitutes an air inlet region 11. When a tobacco rod 2 of a larger second size (FIG. 4A) is inserted the air inlet region 11 is smaller than when a tobacco rod 2 of a smaller first size (FIG. 3A) is inserted. The decrease in the area of the air intake region increases the resistance when the user draws on the device to inhale the vapour. This difference in the resistance to air flow can affect the user experience and the shape of tobacco rod can be designed to select a suitable resistance which is matches each type (or taste) of tobacco. The retention to draw may be adjusted due to the differing size of the air inlet region 11.

The tobacco rod 2 applies a strain to the strain gauges 4; the strain gauges 4 measure this strain. The strain gauges 4 are electrically coupled to the controller 9 and send an electrical signal corresponding to the strain measurement to the controller 9. From the measurement of the strain, the controller 9 determines an operation to be carried out by the vapour generating device. The controller that determines the operation is the same controller that controls the heater 6. In an alternative arrangement separate controllers can be used. The operation can include allowing or preventing the device 1 operating with the received tobacco rod 2, displaying information to the user, or selecting a heating profile for the received tobacco rod 2.

Some types of tobacco rod 2 may be thicker and some types may be thinner and therefore will apply different strains. Different heating profiles may need to be applied to tobacco rods of different thicknesses. Thicker tobacco rods can have a greater volume of a tobacco product to be heated, and will also decrease the size of the air inlets 11. In an example, the operation determined by the controller 9, in response to the measured strain generated by the tobacco rod 2, is to select and apply a specific heating profile for the tobacco rod 2. The controller 9 stores various strain values and corresponding heating profiles relating to various thicknesses of tobacco rod 2. The controller 9 compares the measured strain to the stored strain values and selects the most appropriate heating profile based upon the comparison. Tobacco rods that generate a first strain, i.e. having a first thickness, are assigned a first heating profile, and tobacco rods of a second strain, i.e. having a second thickness, are assigned a second heating profile. The invention is not limited to only two heating profiles and two generated strains; any number of heating profiles can be used, corresponding to any number of generated strains. By measuring strain generated by the tobacco rod the controller 9 can select the most suitable heating profile for different thicknesses of tobacco rod, leading to an optimised user experience.

In another example the measured strain generated by a tobacco rod 2 received in the chamber 3 is used to determine whether the tobacco rod 2 is an authorised or unauthorised type of tobacco rod 2. In this case, the measured strain is compared, by the controller 9, to strain values corresponding to authorised types of the tobacco rod 2 stored at the controller 9. If the measured strain generated by the tobacco rod 2 is determined to correspond to the stored strain value of an authorised type, the controller 9 selects an operation which allows the tobacco rod 2 to be heated by the heater 6. If the measured strain generated by the tobacco rod 2 does not correspond to a stored strain value of an authorised type, the tobacco rod 2 is determined to be an unauthorised type and the controller selects an operation which prevents the tobacco rod 2 from being heated by the heater 6. This control over the use of authorised and unauthorised tobacco rods is used to prevent the use of unauthorised or counterfeit tobacco rods which can have a detrimental effect of the user experience.

In another example the measured strain generated by a tobacco rod 2 received in the chamber 3 is used to determine a type of the tobacco rod 2 so that the type can be displayed to the user. The measured strain is compared, by the controller 9, to strain values of known types of tobacco rod 2 stored at the controller 9. The controller selects a type of the tobacco rod 2 that has a stored strain value that most closely corresponds to the measured strain. The type of the tobacco rod 2 is displayed to the user by way of a display screen. Alternatively, the type of tobacco rod 2 can be displayed by light emitting diodes or the like.

In an alternative embodiment, the vapour generating material 2 is a capsule 2 containing constituents for vaporisation in this embodiment the constituents may be liquid. In such an embodiment, the vapour generating device is arranged and operable substantially as previously described with reference to tobacco rods. In this embodiment the capsule 2 has a recess dimensioned to engage with a correspondingly dimensioned protrusion of the heater 6. In this embodiment the diameter of the capsule must be greater than the predetermined diameter of the heater 6 in the chamber 3, otherwise the protrusion of the heater 6 will be greater in size than the recess of the capsule 2, and the capsule 2 will not be able to engage with the heater 6. In an alternative, the heater has a spiked shape which is inserted into the capsule. Again, in this embodiment the diameter of the capsule must be greater than the predetermined diameter of the heater 6 in the chamber 3, otherwise the spike of the heater 6 will be greater in size than the capsule 2 and the capsule 2 will not be able to engage with the heater 6. FIGS. 5A-D show the interaction between a heater 6 of a fixed size and capsules 2A, 2B, 2C, 2D of increasing size (starting from 2A and increasing in diameter to 2D). In this case, the strain gauges 4 measure the applied strain generated by the received capsule. A capsule with a larger diameter will generate more strain than a capsule with a smaller diameter. The controller 9 stores a threshold strain value corresponding to capsule diameters greater than or equal to a stored diameter of the heater 6. The controller 9 compares the measured strain to the stored threshold strain value to determine if the capsule has a diameter greater than or equal to the known, predetermined diameter of the heater 6, or a diameter less than that of the heater. If the measured strain generated by the capsule is above or equal to the threshold and therefore corresponds to a capsule diameter that is greater than or equal to the known, predetermined diameter of the heater 6, the capsule is determined to be suitable for use in the vapour generating device 1, and the controller 8 selects an operation which allows the heater to heat the capsule 2. If the measured strain generated by the capsule is below the threshold and therefore corresponds to a capsule diameter that is less than the known, predetermined diameter of the heater 6, the capsule is determined to be unsuitable for use in the vapour generating device 1, and the controller selects an operation which prevents the heater from heating the unsuitable capsule 2. Consequently, the controller 9 prevents capsules of an unsuitable type being heated by the heater 6, whilst allowing capsules of a suitable type to be heated by the heater 6. This ensures that a suitable engagement between the capsule and heater is achieved before heating, and reduces the risk of overheating the capsule or heating a capsule that cannot be correctly engaged. In another embodiment, this arrangement of the vapour generating device may be used with tobacco rods instead of capsules.

The described features and embodiments may be combined in any suitable arrangement without departing from the scope of the invention.

The invention claimed is:

1. A vapour generating device comprising:

a chamber for receiving a vapour generating material and having at least one sidewall;

a vaporiser for vaporising the vapour generating material received in the chamber;

at least one strain gauge extending from the at least one sidewall and arranged to measure a strain generated by a vapour generating material received in the chamber; and a controller arranged to determine an operation that is dependent on the measured strain, wherein the at least one strain gauge is configured to be displaced toward the sidewall due to an applied pressure from an abutment of the vapour generating material.

2. The device of claim 1, wherein the vaporiser is a heater arranged to engage the vapour generating material received in the chamber.

3. The device of claim 1, wherein the generated strain is related to a dimension or shape of the vapour generating material received in the chamber.

4. The device of claim 1, wherein the at least one strain gauge is connected to at least one side wall of the chamber.

5. The device of claim 1, wherein the at least one strain gauge comprises two or more strain gauges.

6. The device of claim 5, wherein the two or more strain gauges are evenly distributed around the at least one sidewall of the chamber.

7. The device of claim 1, wherein the strain gauge(s) is/are arranged to guide the vapour generating material toward a desired position in the chamber.

8. The device of claim 1, wherein the strain gauge(s) is/are oriented in the direction of insertion.

9. The device of claim 1, wherein the vaporiser is at an end of the chamber opposite an opening of the chamber, and the strain gauge(s) is/are positioned closer to the opening of the chamber than the vaporiser.

10. The device of claim 1, wherein a size of an air inlet defined by a cross sectional area of the chamber, the strain gauge(s) and the vapour generating material received in the chamber is adjusted according to a cross sectional shape of the vapour generating material received in the chamber, thereby adjusting the retention to draw.

11. The device of claim 1, wherein the controller is arranged to:

compare the measured strain generated by the vapour generating material received in the chamber to a predetermined threshold strain; and select an operation that prevents the vapour generating device from operating with the vapour generating material received in the chamber if the measured strain is less than or more than the predetermined threshold strain.

12. The device of claim 1, wherein the controller is arranged to:

compare the measured strain generated by the vapour generating material received in the chamber to stored information corresponding to strains generated by authorised vapour generating materials;

determine if the vapour generating material received in the chamber is an authorised vapour generating material based on the comparison; and select an operation that prevents the vapour generating device from operating with the vapour generating material received in the chamber if the vapour generating material does not correspond an authorised vapour generating material.

13. The device of claim 1, wherein the controller is arranged to:

compare the measured strain generated by the vapour generating material received in the chamber to stored information corresponding to strains generated by vapour generating materials with associated stored heating profiles; and select an operation, wherein the operation is a heating profile, from the stored heating profiles for use with the vapour generating material received in the chamber based on the measured strain.

14. The device of claim 1, wherein the controller is arranged to:

determine a type of the vapour generating material received in the chamber based on the measured strain; and indicate the type of the vapour generating material received in the chamber to a user of the vapour generating device.

15. A system comprising the device of claim 1 with the vapour generating material received in the chamber.

* * * * *